US011072396B2

(12) United States Patent
Muzzio

(10) Patent No.: US 11,072,396 B2
(45) **Date of Patent: *Jul. 27, 2021**

(54) FREESTANDING ADJUSTABLE RECREATIONAL CANOPY

(71) Applicant: Matthew D. Muzzio, Land O' Lakes, FL (US)

(72) Inventor: Matthew D. Muzzio, Land O' Lakes, FL (US)

(73) Assignee: Adventure Canopies LLC, Land O'Lakes, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/455,153

(22) Filed: Jun. 27, 2019

(65) Prior Publication Data

US 2019/0322336 A1 Oct. 24, 2019

Related U.S. Application Data

(63) Continuation of application No. 16/373,370, filed on Apr. 2, 2019, now Pat. No. 10,407,133.

(60) Provisional application No. 62/660,689, filed on Apr. 20, 2018.

(51) Int. Cl.
*B63B 17/02* (2006.01)
*E04H 15/06* (2006.01)

(52) U.S. Cl.
CPC ..... *B63B 17/02* (2013.01); *E04H 15/06* (2013.01)

(58) Field of Classification Search
CPC ..... E04H 15/06
USPC ..... 114/361; 135/88.01
See application file for complete search history.

(56) References Cited

U.S. PATENT DOCUMENTS 4,597,401 A * 7/1986 Fournier ..... E04H 15/04 135/119
5,135,281 A * 8/1992 Pappalardo ..... A47C 7/66 297/184.15

* cited by examiner

*Primary Examiner* — Noah Chandler Hawk
(74) *Attorney, Agent, or Firm* — Smith & Hopen, P.A.; Paul Murty

(57) ABSTRACT

A height-adjustable canopy assembly that is capable of creating a desired shaded area without restricting a vehicle occupant's ability to enter, exit, control, and enjoy the vehicle. The canopy assembly includes a frame support that is secured to the vehicle via attachment points disposed between a seat and a rear portion of the vehicle. The frame support couples with a canopy support, which is adapted to span along a longitudinal length of the vehicle. A canopy cover attaches to the canopy support, providing a shaded area on the vehicle. The canopy support is adjustable with respect to the vehicle, in particular via a series of cord and cord locks that allow the occupant to quickly raise and lower the canopy support to change the shaded area to a desired set of dimensions.

20 Claims, 9 Drawing Sheets

FREESTANDING ADJUSTABLE RECREATIONAL CANOPY

CROSS-REFERENCE TO RELATED APPLICATIONS

This nonprovisional application is a continuation of and claims priority to nonprovisional application Ser. No. 16/373,370, entitled "Freestanding Adjustable Recreational Canopy," filed Apr. 2, 2019 by the same inventor, which is a continuation of and claims priority to provisional application No. 62/660,689, entitled "Freestanding Adjustable Recreational Canopy," filed Apr. 20, 2018 by the same inventor, the entireties of which are incorporated herein by reference.

BACKGROUND OF THE INVENTION

1. Field of the Invention

This invention relates, generally, to canopies. More specifically, it relates to a freestanding and adjustable vehicle canopy that is height-adjustable, allowing a user to easily customize a shaded area from a resting position. In addition, the canopy is designed to connect to the vehicle at attachment points that are located behind the user's resting location, allowing the use of a canopy frame that diminishes restrictions to the user's view from the resting position.

2. Brief Description of the Prior Art

During warm and sunny months, such as those occurring in the spring, summer, and fall, people tend to spend time in the outdoors. Popular activities during these times include pleasure boating on open-top large or small watercraft, such as kayaks, canoes, and other boats; riding on land vehicles, such as motorcycles and convertible-top automobiles; and simply sitting or lying outside in the sunlight. However, such weather can cause the user to be exposed to dangerous temperature and ultraviolet rays, which can lead to sun-related conditions, including squamous cell skin carcinoma and melanoma.

Some open-top vehicles include structures designed to provide shade for occupants, which may be permanently-or-temporarily deployed. For example, a midsize or large boat typically includes an awning spanning from starboard to port side of the vessel, thereby providing shade for vessel occupants underneath the awning. However, such a large awning is unpractical for use on smaller craft, such as kayaks and canoes. Instead, these smaller crafts typically include a smaller shade structure, such as a canopy, which is designed to provide shade without encumbering the vehicle with a bulky and heavy awning.

For example, U.S. Pat. No. 7,984,686 to Solorzano provides a canopy having a rigid, rectangular frame attached to a small vessel via a pair of legs, with one leg being disposed in front of an occupant, and the other leg disposed behind the occupant. The canopy is attached so that the longitudinal side of the canopy is parallel with the longitudinal side of the vessel. While Solorzano teaches a canopy to provide shade, the canopy is not height-adjustable, and the attachment of the legs obscures the occupant's view in at least one direction. Additionally, because the support frames of Solorzano are parallel to each other and to the direction of travel (along the longitudinal side of the vessel), sharp movements and environmental factors, such as wind and waves, that affect the sides of the vessel would destabilize the canopy, thereby risking toppling the vessel. Similar problems are faced by U.S. Pat. No. 7,690,390 to Hopkins, which provides an arched canopy attached along the longitudinal side of a vehicle, with anchor points in front of and behind an occupant.

In addition, U.S. Pat. No. 7,424,862 to Wagner provides a collapsible sunshade for use on a small vessel. The sunshade attaches to the sides of the vessel through a series of poles and anchor points, such that the sunshade covers substantially the entire surface area of the vessel. However, by placing the poles and anchor points on the sides of vessel, next to where an occupant would sit while using the vessel, Wagner's sunshade makes egress from and regress to the vessel difficult for an occupant. In addition, the location of the poles and anchor points increases the difficulty of rowing the vessel, which is typically performed on the sides of a vessel, by restricting the occupant's range of rowing. Similar problems are faced by U.S. Pat. No. 4,683,900 to Carmichael, which provides a canopy attached to the sides of a vessel, such that an occupant's ability to enter, exit, and operate the vessel is restricted.

Accordingly, what is needed is an adjustable canopy for use with vehicles, such as open-top kayaks and canoes, that is capable of providing shade to vehicle occupants without obstructing the occupant's view from the vehicle, and without restricting the ability to operate the vehicle. However, in view of the art considered as a whole at the time the present invention was made, it was not obvious to those of ordinary skill in the field of this invention how the shortcomings of the prior art could be overcome.

BRIEF SUMMARY OF THE INVENTION

The long-standing but heretofore unfulfilled need for a height-adjustable canopy that does not restrict an occupant's ability to use and enjoy a vehicle, while allowing the occupant to easily adjust the canopy height and shaded area to shield the occupant from harmful radiation and heat, is now met by a new, useful, and nonobvious invention.

The novel structure includes a frame support, a canopy support, and a canopy cover. The frame support is adapted to couple to a vehicle via a plurality of attachment points that are disposed on the vehicle, between a seat and a rear portion of the vehicle. In an embodiment, a pair of first attachment points are disposed between the seat and the rear portion of the vehicle, and a pair of second attachment points are disposed between the seat and the first attachment points. The distance between the first attachment points is less than the distance between the second attachment points.

The frame support includes a first set of angled support members, and a second set of angled support members. Each angled support member has a body extending from a first end to a second end, with the first end adapted for attachment to the vehicle via one of the plurality of attachment points. The second end of each angled support member is adapted to couple to a connector that is disposed above the vehicle. The angled support members may include a shock cord disposed through hollow cross-sections thereof, with the shock cord having a length shorter than or equal to a length of the angled support members when there is no tension force on the shock cord. Such a shock cord can aid in the assembly, disassembly, and storage of the angled support members by substantially maintaining the order of parts regardless of the status of assembly of the frame support. Shock cords may also be used in the canopy support components.

A cross connector having two channels may be slidably securable about the first and/or second sets of angled support members to secure the selected set of angled support members together, with a sliding translation of the cross connector functioning to raise and lower the canopy support with respect to the vehicle.

The canopy support is couplable to the connector and is adapted to extend away from the connector along a longitudinal length of the vehicle. As such, the canopy support may be described as being cantilevered from the connector out over the seat of the vehicle. The canopy support includes a plurality of longitudinal support members that are disposed along the longitudinal length of the vehicle. In addition, the canopy support includes a plurality of transverse support members that are connected to each of the longitudinal support members. The transverse support members are adapted to maintain the structure of the longitudinal support members, thereby providing a support for a canopy cover. Each of the longitudinal supports secure against one of the plurality of attachment points via a cord-and-cord-lock system. Specifically, each cord is insertable within a cord lock, with the cord lock being adapted to change a length of each of the first and second cords, thereby changing a distance between the canopy support and vehicle (i.e., raising and lowering the canopy support with respect to the vehicle, thereby adjusting the height of the canopy cover, as well as adjusting the shaded area of the vehicle). The canopy cover is attachable to the canopy support, with the canopy cover being adapted to provide a shaded area for an occupant of the vehicle.

The connectors of the structure may be tee-connectors having a first channel, a second channel, and a third channel disposed therein. To aid in the flexibility of the system, the second channel may be offset from the first and third channels by approximately 10° from normal. Stated another way, the first and second channels may define an angle of approximately 80° or 100° therebetween. This angle may alternatively be normal, or 90°, depending on the flexibility requirements of the assembly. The first and third channels define an angle of approximately 180°±10°.

The canopy support may further include a first canopy support member and a second canopy support member that are adapted to receive the canopy cover. The first and second canopy support members are adapted to extend along the longitudinal length of the vehicle in substantially the same direction as the longitudinal support members, and are securable to the longitudinal support members via connectors, such as tee-connectors. Transverse support members function to secure each of the canopy support members together to enhance the structural integrity of the assembly, particularly in a vehicle usable in recreational applications, such as kayaks on open bodies of water. A transverse support member disposed approximately above a seat of the vehicle may be longer than a transverse support member disposed at the front of the vehicle, such that the canopy support members can be angled toward the sides of the vehicle, providing a greater degree of shade near the seat of the vehicle (and near an occupant) than at the front of the vehicle.

An object of the invention is to provide an assembly that allows a vehicle occupant to easily adjust a canopy to provide a desired shaded area, with the assembly being installed behind the occupant, so that the occupant's ability to use and enjoy the vehicle is not restricted.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

As used in this specification and the appended claims, the singular forms "a," "an," and "the" include plural referents unless the content clearly dictates otherwise. As used in this specification and the appended claims, the term "or" is generally employed in its sense including "and/or" unless the context clearly dictates otherwise.

The present invention includes a height-adjustable canopy coupled to a vehicle via a support frame. Examples of vehicles include, but are not limited to, kayaks, canoes, jet skis, and other small watercraft, as well as scooters, motorcycles, all-terrain vehicles, and any other vehicle in which an occupant's head may be exposed to sunlight, such as an open-top vehicle. The support frame attached to the vehicle behind the occupant, such that the occupant has the ability to control and maneuver the vehicle during use. The canopy provides shade to the occupant without substantially obstructing the occupant's view through the sides and front of the vehicle.

Figure 1:
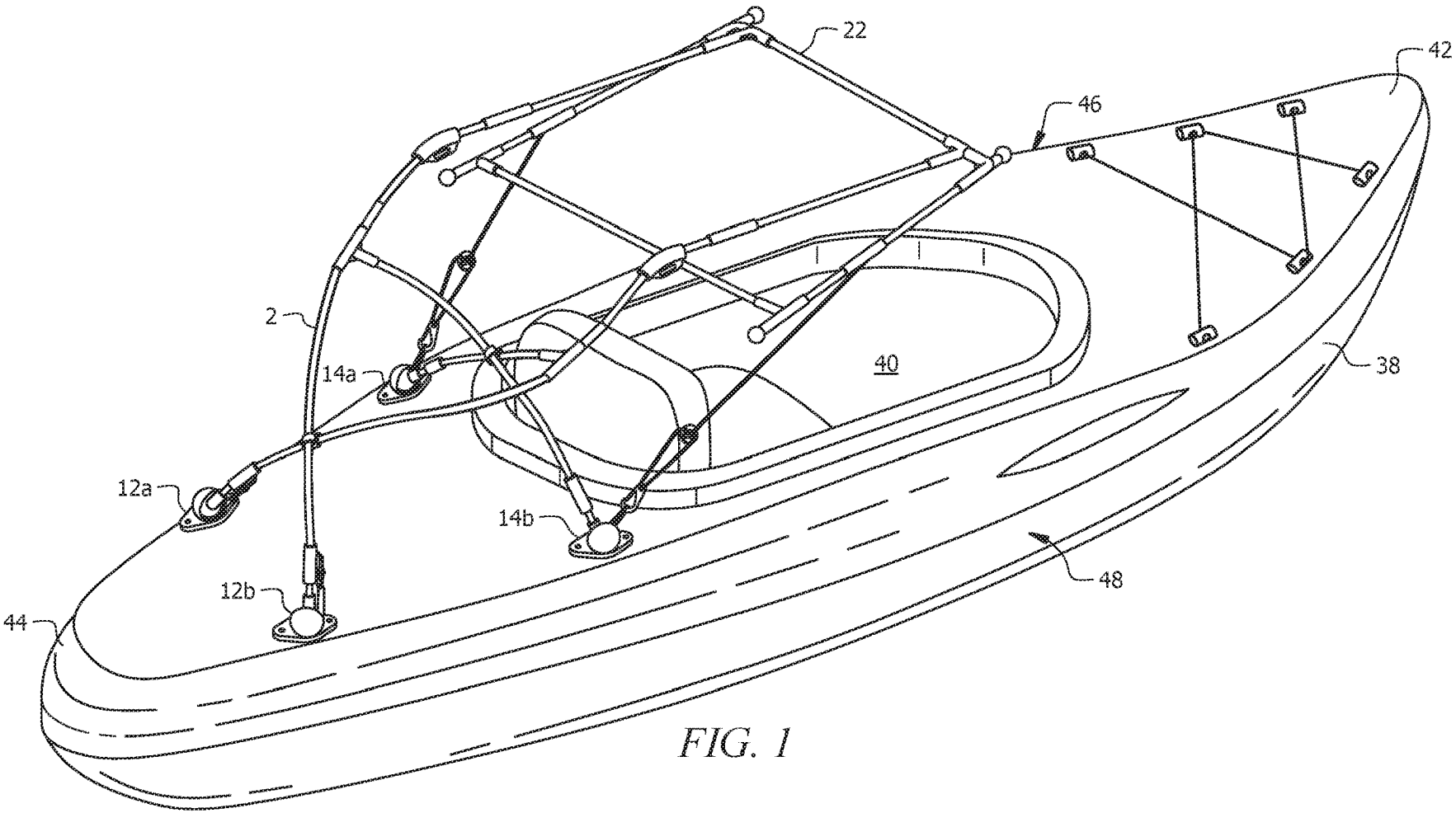
FIG. 1 is a perspective view of a height-adjustable canopy assembly attached to a vessel, the assembly including a frame support coupled to a canopy support.

As depicted in FIG. 1, the height-adjustable canopy assembly includes frame support 2 and canopy support 22. Frame support 2 is adapted to couple to vessel 38 via first attachment points 12*a* and 12*b*, as well as second attachment points 14*a* and 14*b*. Each attachment point includes a base platform that secures against vessel 38, with one or more fastener apertures disposed thereon to allow for the insertion of fasteners, such as screws or bolts. Alternatively, the attachment points could include an adhesive for securing the base platform against vessel 38. In addition, each attachment point further includes a female receipt disposed within the base platform and angled with respect to a vertical axis of the base platform, thereby allowing for the securing and retaining of a male member inserted therein. The shape and size of the attachment points 12*a*, 12*b*, 14*a*, and 14*b* will be shown in more detail in later figures, and described in more detail in the paragraphs below.

Figure 2:
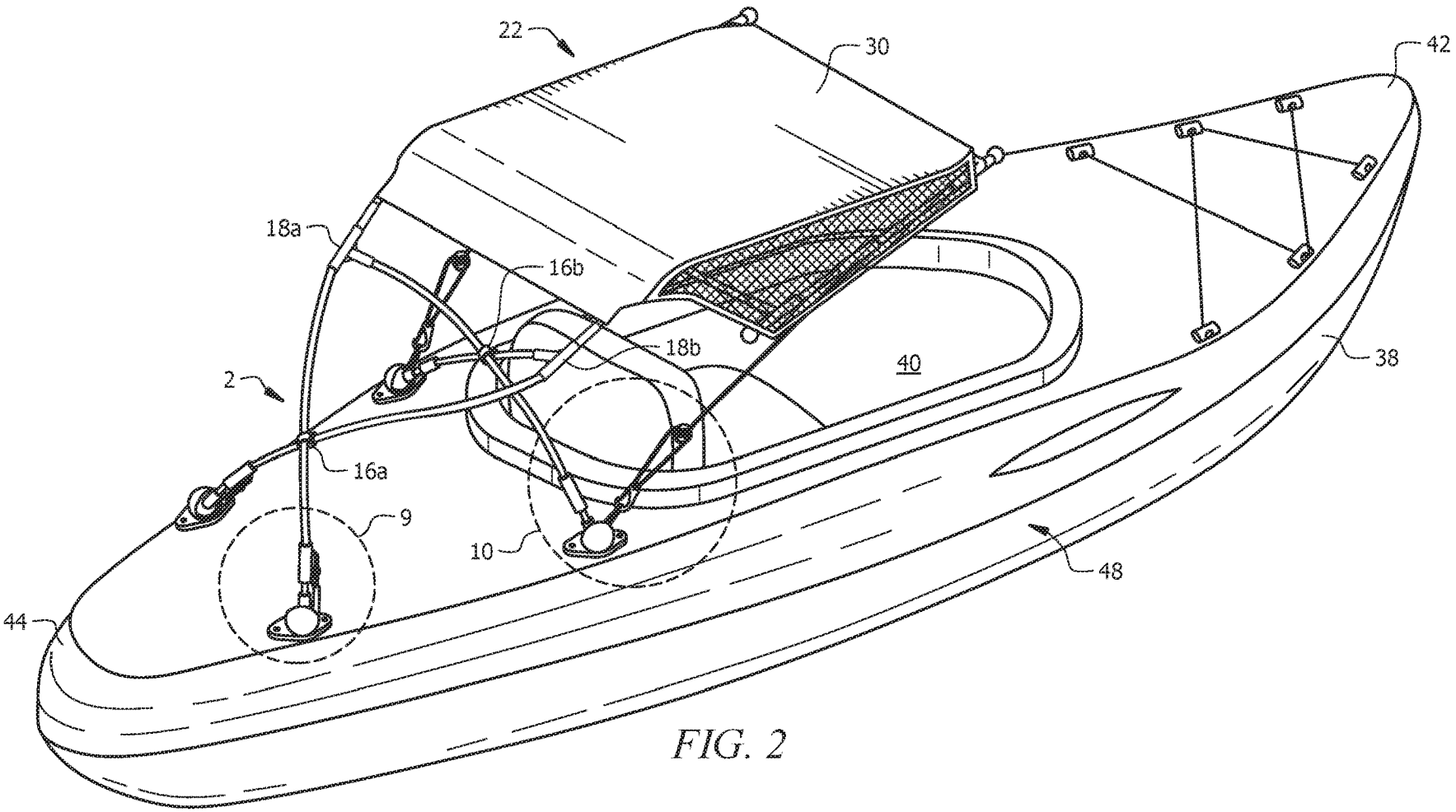
FIG. 2 is a perspective view of the height-adjustable canopy assembly of FIG. 1 attached to a vessel, the assembly including a frame support coupled to a canopy support, and a canopy secured to the canopy support.

Vessel 38 includes front end 42 opposite rear end 44 along a longitudinal axis of vessel 38, and port side 46 opposite starboard side 48 along a transverse axis of vessel 38. Seat 40 is disposed within vessel 38 and between front end 42 and rear end 44, as well as between port side 46 and starboard side 48. As shown in FIG. 1, each of first attachment points 12*a*, 12*b* and second attachment points 14*a*, 14*b* are located between seat 40 and rear end 44. Canopy support 22 attaches to frame support 2 in a manner that will be described in greater detail below. FIG. 2 shows many of the components described above, as well as canopy 30 secured against canopy support 22. In addition, FIG. 2 shows cross-connectors 16*a* and 16*b*, which secure angled support members together on frame support 2; as well as tee-connectors 18*a* and 18*b*, which secure various support members together. The connectors will be described in more detail below.

Figure 3:
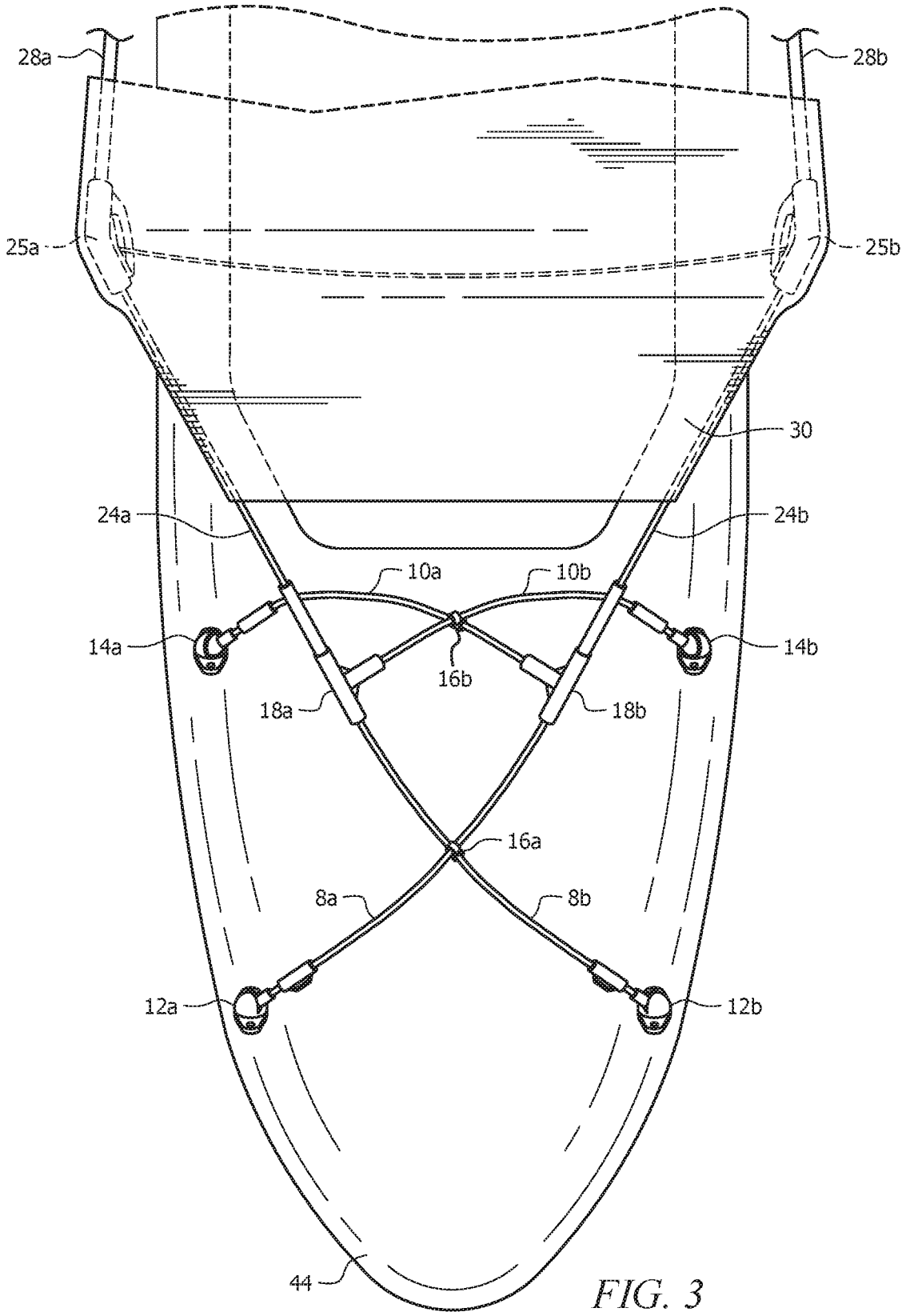
FIG. 3 is a top-down partial elevation view of the height-adjustable canopy assembly of FIG. 1 attached to a rear portion of the vessel.

As shown in FIG. 3, the components of frame support 2 in particular are shown in greater detail. Frame support 2 includes angled support members 8*a*, 8*b*, 10*a*, and 10*b*, with each angled support member designed to attach to vessel 38 through one of the attachment points. For example, angled support member 8*a* couples with first attachment point 12*a*; angled support member 8*b* couples with first attachment point 12*b*; angled attachment member 10*a* couples with second attachment point 14*a*; and angled attachment member 10*b* couples with second attachment point 14*b*. FIG. 3 depicts the angled support members as terminating in a spherical head portion that is received by the female receipts on the attachment points; however, it is appreciated that alternative means of coupling the components together are contemplated, such as a nut-and-bolt configuration, a screw-threading relationship, hook-and-loop fasteners, or other common methods known to a person of ordinary skill in the art. Because the attachment points are disposed between seat 40 and rear end 44 of vessel 38, the angled support members are also disposed between seat 40 and rear end 44 when installed on vessel 38.

FIG. 3 also shows that angled support members 8*a* and 8*b*, as well as angled support members 10*a* and 10*b*, are adapted to cross-over each other when installed on vessel 38, such that a member that is installed on port side 46 terminates on starboard side 48, and vice versa. As such, one end of angled support member 8*a* is disposed adjacent to an end of angled support member 10*b*, and one end of angled support member 8*b* is disposed adjacent to an end of angled support member 10*a*. By crossing-over each other in such a manner, the angled support members allow the distance between canopy support 22 and vessel 38 to be adjusted, allowing an occupant to adjust the height of canopy support 22 for comfort and optimal shading. Frame support 2 also includes cross-connector 16*a*, which includes two spaced-apart receipts (for example, forming a w-shape, similar to a w-shape crimp connector), each of which is sized and shaped to receive and retain one of angled support members 8*a*, 8*b*. Similarly, frame support includes cross-connector 16*b*, which is substantially identical to cross-connector 16*a*, and which is sized and shaped to retain angled support members 10*a* and 10*b*. As such, cross-connectors 16*a* and 16*b* improve the stability of frame support 2, by reducing the effects of exterior elements, such as wind and waves, on the individual components of frame support 2. It is appreciated that in an embodiment, only cross-connector 16*a* may be used; in an alternative embodiment, both cross-connectors 16*a* and 16*b* may be used on frame support 2.

In an embodiment, each of angled support members 8*a*, 8*b*, 10*a*, and 10*b* are tubular in design, thereby allowing a shock cord to be disposed therethrough. A shock cord is an elastic cord or wire that can be disposed through the substantially hollow, tubular support members. The shock cord is an elastic string that experiences a tension when its length is greater than its natural length, thereby maintaining a connection between support members. In addition, the members are connected via slip connectors, which are structures that form a connection by sliding one part over another part to unite the parts. Slip connectors allow for easy assembly and disassembly of component members. The use of shock cords and slip connectors allows for connections of support members to be linked, even when the components of frame support 2 are disassembled, preventing individual members from becoming lost from the set of members, and allowing the ordered arrangement of members to be maintained regardless of whether frame support 2 is assembled or disassembled.

Also shown in FIG. 3 is the connection between frame support 2 and canopy support 22. FIG. 3 shows the attachments between canopy support 22 and frame support 2, forming the canopy assembly. Frame support 2 connects to canopy support 22 via coupling members 24*a*, 24*b*. A first end of each of coupling members 24*a*, 24*b* attaches to one of tee-connectors 18*a*, 18*b*, allowing coupling members 24*a* and 24*b* to extend away from frame support 2. Similarly, a second end of each of coupling members 24*a*, 24*b* attaches to one of tee-connectors 20*a*, 20*b*, which is are each component parts of canopy support 22. Accordingly, canopy support 22 and frame support 2 are indirectly coupled via coupling members 24*a*, 24*b*. In particular, FIG. 3 shows that coupling members 24*a* and 24*b* secure to the angled support members of frame support 2 via tee-connectors 18*a* and 18*b*. Particularly, coupling member 24*a* connects to each of angled support member 8*b* and angled support member 10*b* via tee-connector 18*a*, such that each of coupling member 24*a*, angled support member 8*b*, and angled support member 10*b* are secured to tee-connector 18*a*. Similarly, coupling member 24*b* connects to each of angled support member 8*a* and angled support member 10*a* via tee-connector 18*b*, with each of coupling member 24*b*, angled support member 8*a*, and angled support member 10*a* being secured to tee-connector 18*b*. The opposing ends of each of coupling members 24*a* and 24*b* secure to elbows 25*a* and 25*b*, respectively, with the opposing ends of each of elbows 25*a* and 25*b* receiving longitudinal support members 28*a* and 28*b*, respectively. The opposing ends of elbows 25*a*, 25*b* define an obtuse angle therebetween, such that longitudinal support member 28*a*, 28*b* can extend therefrom toward front side 42 of vessel 38 to provide shade for an occupant without obstructing the occupant's view. Longitudinal support members 28*a* and 28*b* are components of canopy support 22, and will be discussed in greater detail below.

Figure 4:
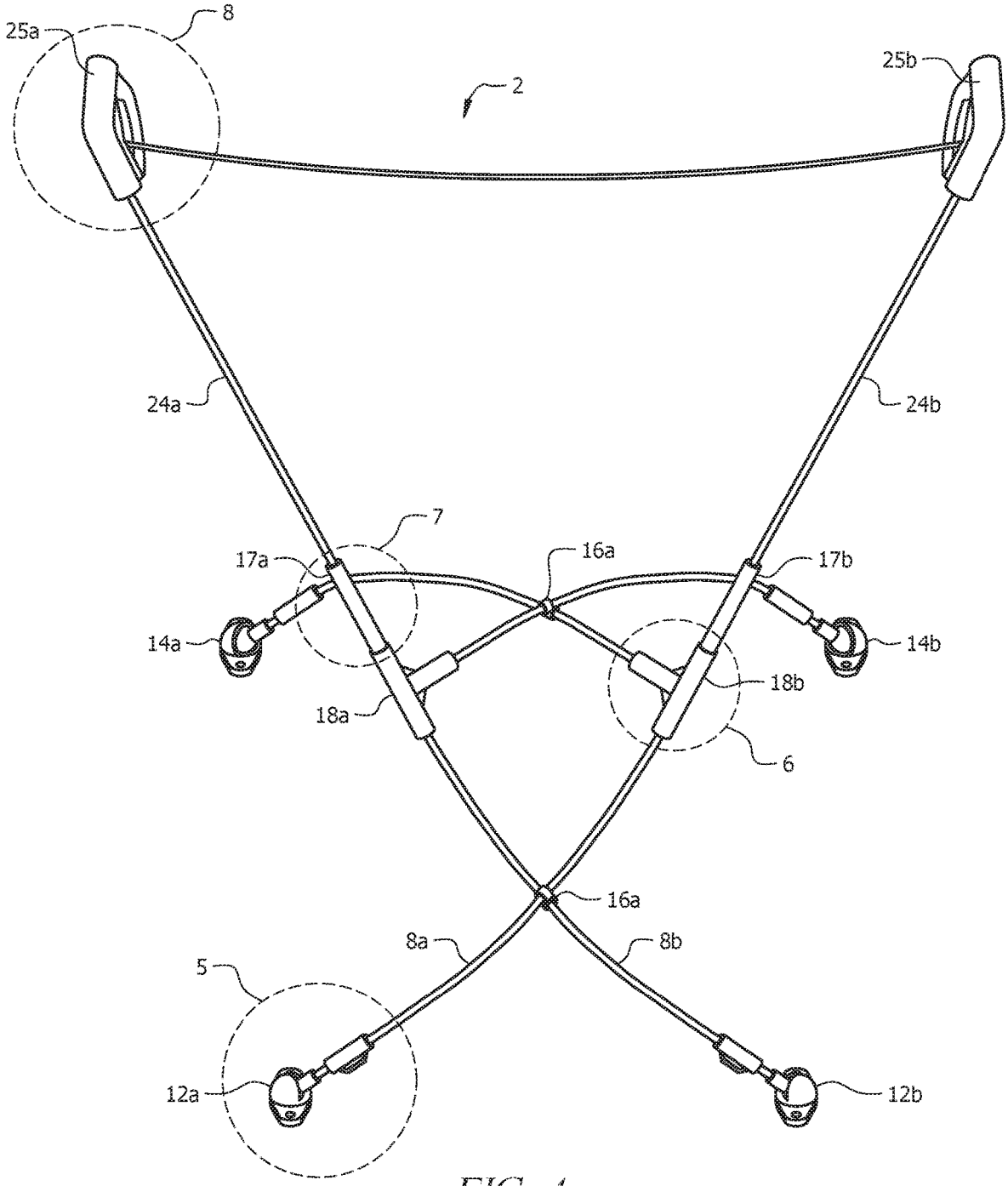
FIG. 4 is a top-down elevation view of the components of the frame support of FIG. 1.

FIG. 4 shows the components of frame support 2 in more particular detail, removing the depictions of the vessel 38 and canopy support 22 to focus on the components of frame support 2. To complete frame support 2, the angled support members attach to one another, such that frame support 2 forms X-shapes when viewed along the longitudinal axis of vessel 38, such as at front end 42 and rear end 44; and A-shapes when viewed along the transverse axis of vessel 38, such as at port side 46 and starboard side 48 (the X-shapes and A-shapes are best seen in the perspective views of FIGS. 1-2). To form these shapes, angled support member 8*a* attaches to angled support member 10*b* via tee-connector 18*a*, and angled support member 8*b* attaches to angled support member 10*a* via tee-connector 18*b*, as discussed above. Each of tee-connectors 18*a*, 18*b* includes three (3) ports arranged in a shape that resembles a "T," with the hollow nature of tee-connectors 18*a*, 18*b* providing a receipt through which one of the angled support members can be inserted and retained. All three ports of tee-connectors 18*a*, 18*b* could be in communication with each other, allowing the tee-connectors to freely translate along the length of the support members to which the tee-connectors are attached. Alternatively, the tee-connectors could include a set of internal walls, or a singular internal wall, separating the vertical section of the "T" from each of the horizontal sections, thereby preventing translation of the tee-connectors along the lengths of the support members. By using tee-connectors 18*a*, 18*b*, opposing angled support members of frame support 2 can secure against each other, providing a stable and secure frame support 2 for the installation of canopy support 22.

Also shown in FIG. 4 are ferrule members 17*a* and 17*b* which can be used to further secure the components of frame support 2 together. For example, as shown in FIG. 4, ferrule member 17*a* is disposed adjacent to tee-connector 18*a* and surrounds a portion of coupling member 24*a*. Similarly, ferrule member 17*b* is disposed adjacent to tee-connector 18*b* and surrounds a portion of coupling member 24*b*. Each of ferrule members 17*a* and 17*b* can slide along the length of coupling members 24*a* and 24*b*, respectively, to enhance the strength of the connection between coupling members 24*a*, 24*b* and either tee-connectors 18*a*, 18*b*, or elbows 25*a*, 25*b*, depending on the requirement of the particularly orientation of frame support 2.

FIG. 4 includes various sections that are circled in broken lines. The subject matter of these circled sections is shown in greater detail in the figures following FIG. 4, corresponding with the reference numerals denoting the circled sections. As such, first attachment point 12*a* is shown in greater detail in FIG. 5; tee-connector 18*b* is shown in greater detail in FIG. 6; ferrule member 17*a* is shown in greater detail in FIG. 7; and elbow 25*a* is shown in greater detail in FIG. 8. FIG. 5-8 will be described in greater detail below.

Figure 5:
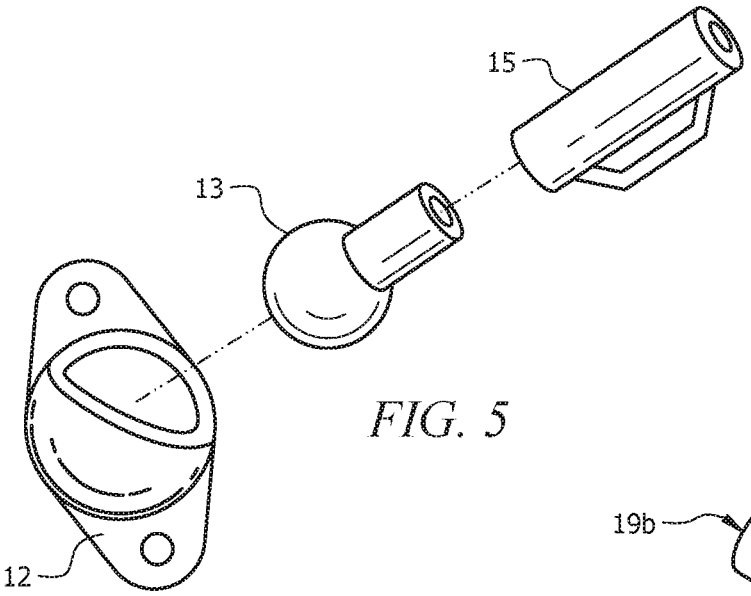
FIG. 5 is a close-up perspective view of a coupling mechanism that is circled in broken lines and denoted with reference numeral 5 in FIG. 4.

As shown in FIG. 5, attachment point 12 (which is used herein as a general reference numeral referring to first attachment point 12*a* or 12*b*; in addition, the attachment mechanism shown in FIG. 5 and described herein applies to second attachment points 14*a* and 14*b* as well, since a similar ball-and-receipt mechanism can be used to connect the support members to the attachment points, as will be discussed herein) is shown in detail. Also shown in FIG. 5 is head portion 13, which is depicted as a spherical ball-shaped component. In the embodiment depicted in FIG. 5, head portion 13 forms a terminal end of angled support member 8*a*; however, in line with the discussion above, head portion 13 also forms a terminal end of each of angled support members 8*b*, 10*a*, and 10*b*. Ferrule member 15 surrounds the angled support member coupled to head portion 13, with ferrule member 15 designed to strengthen the connection between the angled support members. To secure the selected angled support member to attachment point 12, head portion 13 is inserted within and received by a receipt formed by attachment point 12. As shown in the previous figures, such as FIG. 4, when all four of angled support members 8*a*, 8*b*, 10*a*, and 10*b* are received within respective first attachment points 12*a*, 12*b* and second attachment points 14*a*, 14*b*, frame support 2 is formed.

Figure 6:
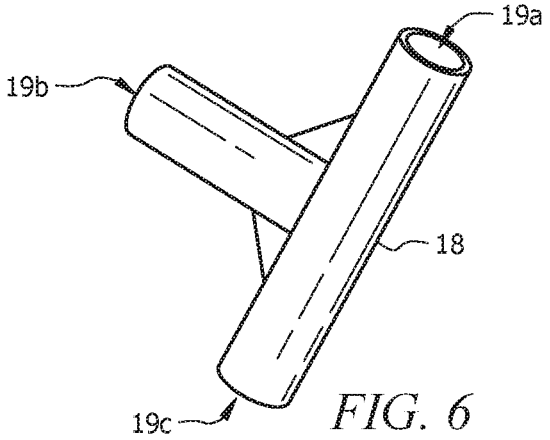
FIG. 6 is a close-up perspective view of a tee-connector component that is circled in broken lines and denoted with reference numeral 6 in FIG. 4.

Turning now to FIG. 6, tee-connector 18 (similar to attachment point 12, tee-connector 18 is used herein as a general reference numeral referring to tee-connectors 18*a* and 18*b*, as well as 20*a*, 20*b*, 36*a*, and 36*b*, which will be described in detail below) is shown in detail. Tee-connector 18 includes three channels, as discussed above-first channel 19*a*, second channel 19*b*, and third channel 19*c*. First and third channels 19*a*, 19*c* are disposed opposite each other in a substantially 180° angled orientation, with second channel 19*b* extending approximately perpendicularly from first and third channels 19*a*, 19*c*. In an embodiment, second channel 19*b* forms an angle that is offset by approximately 10° from normal to provide additional flexibility between the support members secured therein, reducing a risk of the individual support members fracturing or disconnecting from respective tee-connectors. Additionally, in an embodiment, first and third channels 19*a*, 19*c* are disposed opposite each other and forming an angle of approximately 170° therebetween, with an angle of 80° formed between first channel 19*a* and second channel 19*b*, and an angle of 90° formed between third channel 19*c* and second channel 19*b*.

Figure 7:
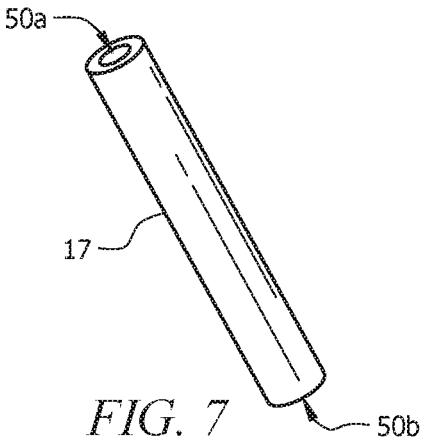
FIG. 7 is a close-up perspective view of a ferrule pole component that is circled in broken lines and denoted with reference numeral 7 in FIG. 4.

Referring now to FIG. 7, ferrule member 17 (similar to the components in FIGS. 5-6 discussed above, ferrule member 17 is used herein as a general reference numeral referring to ferrule members 17*a* and 17*b*, as well as other non-labeled ferrule members that may be included in embodiments of the present invention) is shown in detail. Ferrule member 17 includes a channel disposed therethrough, such that ferrule member 17 can surround an elongated component having an outer diameter smaller than an inner diameter of ferrule member 17. For example, as shown in FIG. 4, ferrule members 17*a*, 17*b* surround coupling members 24*a*, 24*b*, respectively. To surround elongated components having smaller outer diameters, ferrule member 17 includes first opening 50*a* opposite second opening 50*b*, with a distance between first and second openings 50*a*, 50*b* defining a channel through ferrule member 17 that is sized and shaped to receive and surround an elongated component, such as coupling members 24*a*, 24*b*, as shown in FIG. 4. As such, ferrule member 17 is slidably adjustable along a longitudinal axis of a surrounded elongated component.

Figure 8:
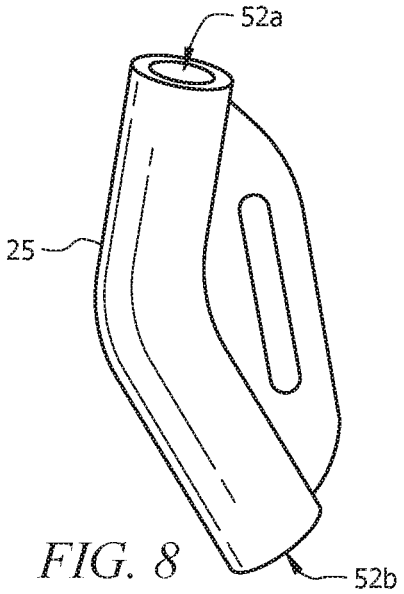
FIG. 8 is a close-up perspective view of an elbow component that is circled in broken lines and denoted with reference numeral 8 in FIG. 4.

Turning to FIG. 8, elbow 25 (similar to the components in FIGS. 5-7 discussed above, elbow 25 is used herein as a general reference numeral referring to elbows 25*a* and 25*b*) is shown in detail. Similar to ferrule member 17 shown in FIG. 7, elbow 25 includes first opening 52*a* opposite second opening 52*b*, with a distance between first and second openings 52*a*, 52*b* defining a channel through elbow 25. The channel through elbow 25 can be continuous from first opening 52*a* through second opening 52*b*, or can include a wall or other solid member disposed therein to separate first opening 52*a* from second opening 52*b*. As shown in FIG. 8, first opening 52*a* is angularly offset from second opening 52*b* of elbow 25, such that an obtuse angle is formed between the body components disposed adjacent to each of first opening 52*a* and second opening 52*b*. The obtuse angle of elbow 25 is such that elbow 25 can be employed as a transition or connecting unit between frame support 2 and canopy support 22, as shown in particular in FIG. 3.

Figure 9:
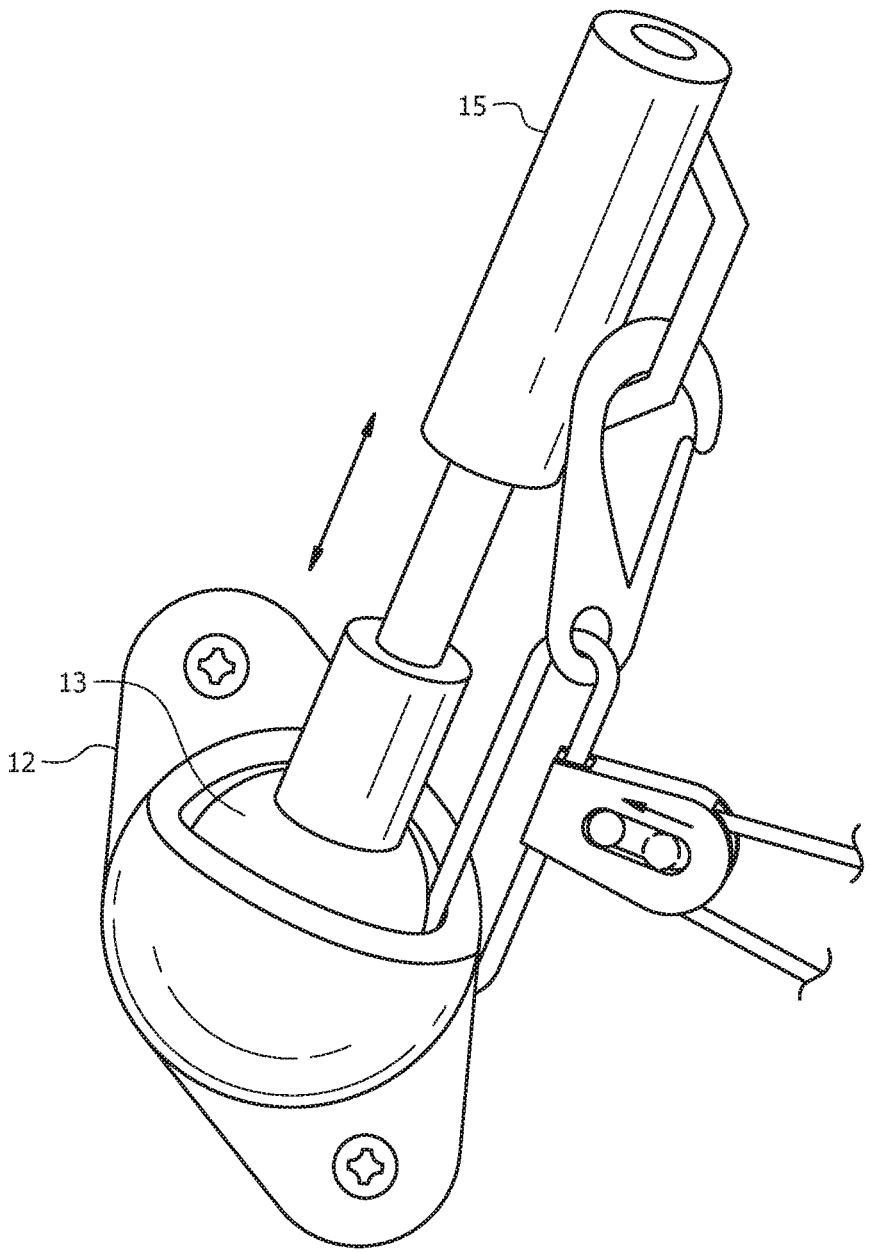
FIG. 9 is a close-up perspective view of a coupling mechanism that is circled in broken lines and denoted with reference numeral 9 in FIG. 2.
Figure 10:
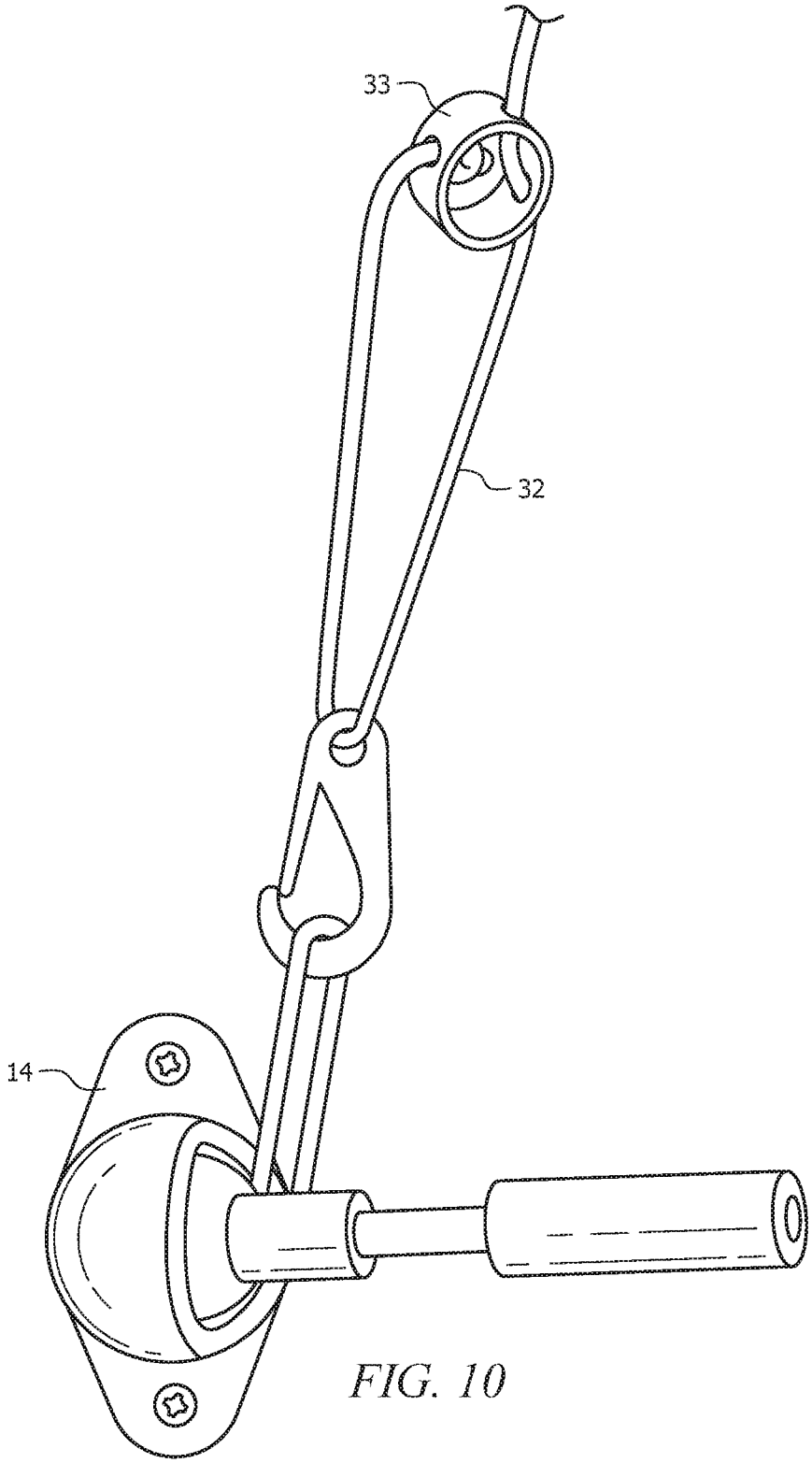
FIG. 10 is a close-up perspective view of a sliding, adjustable cord-and-lock mechanism of the assembly of FIG. 1, the mechanism being circled in broken lines and denoted with reference numeral 10 in FIG. 2.

Referring again to FIG. 2, which shows an assembled frame support 2 coupled to canopy support 22, various components are circled in broken lines, similar to those circled in FIG. 4. The subject matter of these circled sections is shown in greater detail in FIGS. 9-10, corresponding with the reference numerals denoting the circled sections. As such, FIG. 9 shows attachment point 12 in greater detail; and FIG. 10 shows attachment point 14, as well as cord 32 and cord lock 33, in more detail. As shown in FIG. 9, ferrule member 15 can slidably translate along an angled support member in a direction toward and in a direction away from attachment point 12. In addition, FIG. 9 shows a cord lock including a pressable button to lock and unlock a sliding mechanism on the cord lock, allowing a length of cord to be shortened or lengthened, depending on the installation requirements of frame support 2 and canopy support 22. Similarly, ferrule member 15 can slide in relation to attachment point 12 to shorten or lengthen the distance between canopy support 22 and frame support 2, depending on the installation requirements of the assembly. FIG. 10 shows the relationship between cord lock 33 and cord 32 which indirectly couple frame support 2 with canopy support 22, and which can be lengthened or shortened similar to the system shown in FIG. 9. The cord lock 33 and cord 32 system will be described in greater detail below in relation to the adjustment of the entire assembly.

Figure 11:
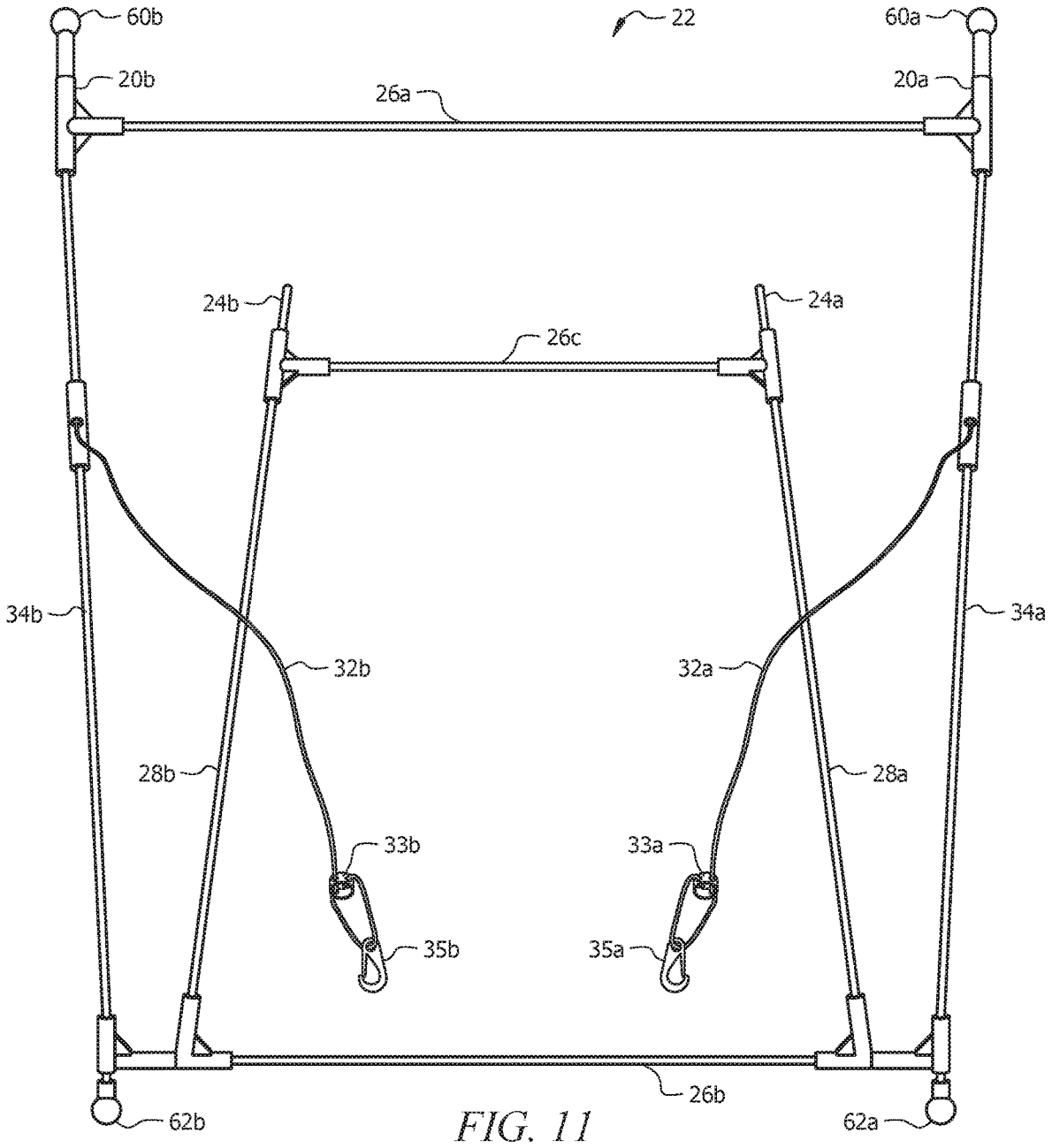
FIG. 11 is an elevation view of the components of the canopy support of the assembly of FIG. 1.

Referring now to FIG. 11, canopy support 22 is shown in greater detail. Canopy support 22 couples to frame support 2, in part, via coupling members 24*a* and 24*b* (also shown in detail, in particular, in FIGS. 3-4) and longitudinal support members 28*a* and 28*b*. Longitudinal support members 28*a*, 28*b* are disposed parallel to the longitudinal axis of vessel 38, which is substantially parallel to a traveling surface, such as the surface of a body of water. Longitudinal support members 28*a*, 28*b* are adapted to extend toward front end 42 of vessel 38, being indirectly anchored to vessel via first and second attachment points 12*a*, 12*b*, 14*a*, 14*b*. Longitudinal support members 28*a*, 28*b* are therefore indirectly anchored at a location behind seat 40 of vessel 38, and extend toward front end 42 of vessel 38, allowing for an occupant to be shaded while using vessel 38. In addition, longitudinal support members 28*a* and 28*b* allow the occupant to be shaded while preventing canopy support 22 from obstructing the view of the occupant. Accordingly, the occupant can be shaded by canopy support 22 without distracting the occupant from looking out of front end 42 of vessel 38. Longitudinal support members 28*a*, 28*b* are coupled to each other to provide structural stability to canopy support 22. Transverse support members 26*b* and 26*c* couple to tee-connectors disposed within canopy support 22, thereby connecting longitudinal support member 28*a* to longitudinal support member 28*b*.

Figure 12:
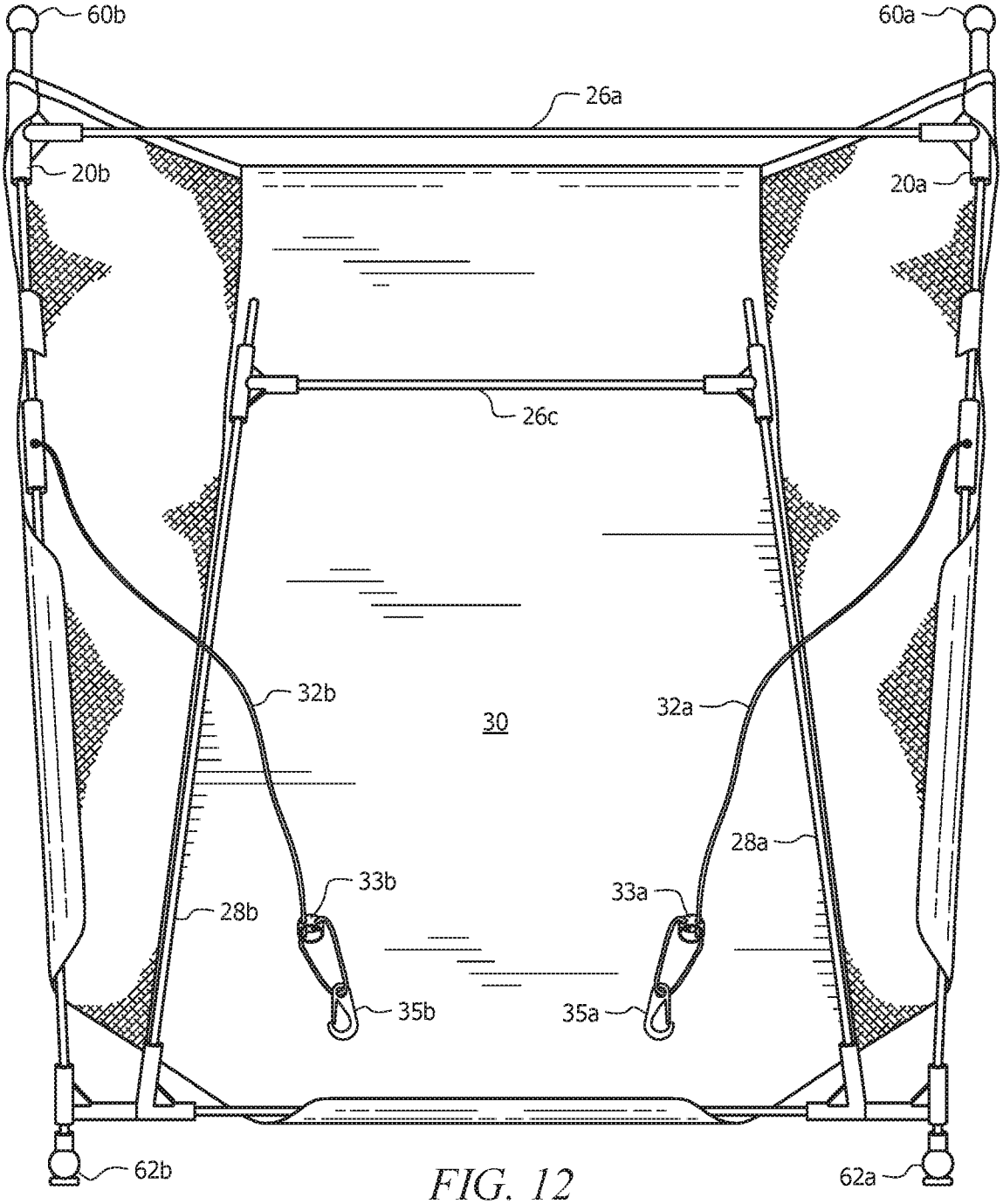
FIG. 12 is an assembled view of the canopy support of FIG. 11, including a canopy secured to the canopy support.

Canopy support 22 is designed to provide shade for an occupant of vessel 38. As such, canopy support 22 includes canopy support members 34*a* and 34*b*. Each of canopy support members 34*a*, 34*b* connects to one end of tee-connectors 36*a*, 36*b*, thereby indirectly coupling canopy support member 34*a* with longitudinal support member 28*a* and transverse support member 26*b*. Similarly, canopy support member 34*b* indirectly couples with longitudinal support member 28*b* and transverse support member 26*b*. Tee-connectors 36*a*, 36*b* maintain the connection between the support members, providing a stable frame that forms canopy support 22. Additionally, canopy support members 34*a* and 34*b* are pivotably coupled to tee-connectors 36*a* and 36*b*, respectively. As such, when canopy support members 34*a*, 34*b* are inserted within tee-connectors 36*a*, 36*b*, the canopy support members are free to pivot about a center axis of transverse support member 26*b*. Canopy support members 34*a*, 34*b* terminate in spherical ends 60*a*, 60*b*, 62*a*, and 62*b*. Each of the spherical ends is removable from the assembly and has a greater diameter than a width of canopy support members 34*a*, 34*b*. When canopy 30 is installed on canopy support 22 (as shown in FIG. 12), spherical ends 60*a* and 60*b* function to prevent canopy 30 from slipping off of the assembly during the folding process, and spherical ends 62*a* and 62*b* function to prevent canopy support 22 from disconnecting from frame support 2 when canopy support 22 receives a force in a direction away from the vessel, such as an upward motion to stress canopy support 22. As such, spherical ends 62*a* and 62*b* work in conjunction with cords 32*a* and 32*b* when connected to attachment points 14*a* and 14*b*.

In addition, transverse support member 26*a* is shown in FIG. 11, which spans from canopy support member 34*a* to canopy support member 34*b* via a set of tee-connectors 20*a* and 20*b*. Transverse support member 26*a* prevents rotational movement of canopy support members 34*a*, 34*b* about longitudinal support members 28*a*, 28*b*, particularly in response to environmental conditions, such as wind or movement caused by waves on a body of water. In addition, transverse support member 26*a* maintains a fixed width, and is slidably coupled to canopy support members 34*a*, 34*b*, thereby maintaining stability for canopy support 22 while being capable of translating to alter the dimensions of canopy support 22.

Similar to angled support members 8*a*, 8*b*, 10*a*, and 10*b* above, the support members of canopy support 22 can be linked together via shock cords and slip connectors, which allow for connections of support members to be linked, even when disassembled, preventing individual members from becoming lost from the set of members, and allowing the ordered arrangement of members to be maintained regardless of whether canopy support 22 is assembled or disassembled. In an alternative embodiment, tee-connectors 36*a*, 36*b* may be replaced by elbow units having two ports, with transverse support member 26*b* and longitudinal support members 28*a*, 28*b* being fixedly secured to tee-connectors 36*a*, 36*b*.

As shown in FIG. 12, with canopy support 22 formed, canopy cover 30 can be installed on transverse support member 26*b*, canopy support members 34*a* and 34*b*, and longitudinal support members 28*a* and 28*b*. Canopy cover 30 is a shade-providing body of fabric or flexible material. Canopy support members 34*a* and 34*b* may be pivotably coupled to transverse support member 26*b*, allowing an occupant to pivot transverse support member 26*b* to change the angle of deployment of canopy cover 30. Canopy cover 30 includes channels, either integrally formed or formed via mechanical fasteners, such as hook-and-loop fasteners, through which components of canopy support 22 can be inserted. For example, as shown in FIG. 12 (in combination with FIG. 2), canopy cover 30 is supported by transverse support member 26*b*, canopy support members 34*a* and 34*b*, and longitudinal support members 28*a* and 28*b*, with canopy cover 30 extending from transverse support member 26*b* toward first and second attachment points 12*a*, 12*b*, disposed at rear end 44 of vessel 38. Canopy cover 30 thereby provides a fabric material adapted to be disposed above an occupant of vessel 38, providing shade for occupant. However, as shown in FIG. 12, canopy support members 34*a*, 34*b* not only hold canopy cover 30 in place, but they also provide shade from radiation and light located on port side 46 and starboard side 48 of vessel 38, while simultaneously providing a substantially unobstructed view out of port side 46 and starboard side 48. In addition, the shape and size of canopy support members 34*a*, 34*b* allow the occupant to be able to enter, use, and navigate vessel 38, due to the lack of obstruction on port side 46 and starboard side 48.

The rear width and height of canopy support 22, and consequently of canopy cover 30, can be augmented in a variety of ways, allowing an occupant or user to adapt the canopy to a specific craft, as well as adjust the shading angle. For example, changing a distance between attachment points 14*a*, 14*b*, and a distance between attachment points 12*a*, 12*b*, changes a height of canopy support 22 while maintaining a width between elbows 25*a*, 25*b*. Said another way, the width and structure of canopy support 22 can remain the same while the height of canopy support 22 is augmented by changing a distance between attachment points 14*a* and 14*b*, and/or between attachment points 12*a* and 12*b*. For example, the location of first attachment points 12*a*, 12*b* determines maximum and minimum heights for canopy support, and is dictated by the dimensions of vessel 38. For example, if vessel 38 is a kayak, the distance between first attachments points 12*a*, 12*b* can be as little as approximately eight (8) inches. Alternatively, if vessel 38 is a canoe, which is wider than a kayak from port to starboard side, first attachment points 12*a*, 12*b* can be separated by as much as approximately thirty-six (36) inches or more, depending on the width of vessel 38. Similarly, the distance between second attachments points 14*a*, 14*b* can be as little as approximately eight (8) inches and as much as approximately thirty-six (36) inches or more. The greater the distance between first attachment points 12*a* and 12*b*, the lower the maximum height of canopy support 22, and vice versa. An exemplary shape made by the first attachment points 12*a*, 12*b* and the second attachment points 14*a*, 14*b* is an isosceles trapezoid; however, it is appreciated that the attachment points can be installed in a different arrangement, depending on the dimensions of vessel 38 and the desired height of canopy cover 30. Additionally, the height of canopy cover 30 can be altered by increasing the length of angled support members 8*a*, 8*b*, 10*a*, 10*b*, such as by adding intermediary components to extend the lengths thereof. The additional length of the angled support members increases the distance between vessel 38 and canopy support 22, thereby increasing the height of canopy cover 30.

In addition, in an embodiment, cross-connectors 16*a*, 16*b* can be slidably translated to augment the height of and shading angle of canopy support 22. For example, if cross-connectors 16*a*, 16*b* are translated closer to canopy support 22 than vessel 38, canopy support 22 will be disposed further from vessel 38, thereby increasing the height of canopy cover 30. Similarly, if cross-connectors 16*a*, 16*b* are translated closer to vessel 38, canopy support 22 will lower toward vessel 38, decreasing the height of canopy cover 30. Furthermore, cross-connector 16*b* can be removed, such that angled support members 10*a* and 10*b* do not cross, and instead attach directly to canopy support 22 without crossing over. Such an orientation provides more space within vessel 38, which can allow an occupant to more easily store items in vessel 38, while maintaining a shaded area via canopy cover 30. To aid in the augmentation of canopy support 22, one or more of transverse support members 26*a*, 26*b*, and 26*c* may include two or more telescoping members which can alter the length of the members from port side 46 to starboard side 48.

Referring now to FIGS. 10-12, canopy support 22 also includes cords 32*a* and 32*b*. Cord 32*a* connects to each of canopy support member 34*a* and second attachment point 14*a*, and cord 32*b* connects to each of canopy support member 34*b* and second attachment point 14*b*. The connection between cords 32*a*, 32*b* and attachment points 14*a*, 14*b* is accomplished via clips 35*a* and 35*b*, respectively, with clips 35*a*, 35*b* securing cords 32*a*, 32*b* to attachment points 14*a*, 14*b*. Cords 32*a* and 32*b* are sized to span between canopy support 22 and frame support 2, providing tension between the components of the support to further stabilize canopy cover 30. To stabilize canopy support 22, cords 32*a* and 32*b* are configured to secure within canopy support members 34*a* and 34*b*, respectively, with cords 32*a*, 32*b* running through hollow cross-sections of the canopy support members and terminating at spherical ends 62*a*, 62*b*, respectively. As such, cords 32*a*, 32*b* alter the center of mass of canopy support 22 by directly anchoring canopy support 22 to second attachment points 14*a*, 14*b*. To prevent noise created through movement acting on the joint between cords 32*a*, 32*b* and second attachment points 14*a*, 14*b*, there may be an intermediary loop of fabric coupled to second attachment points 14*a*, 14*b*, allowing cords 32*a*, 32*b* to be indirectly coupled to vessel 38, thereby reducing noise.

Cords 32*a* and 32*b* are designed to be longer than any of angled support members 8*a*, 8*b*, 10*a*, and 10*b*, and each of cords 32*a*, 32*b* include a cord lock, allowing the distance between canopy support members 34*a*, 34*b* and second attachment points 14*a*, 14*b* to be adjusted. For example, cord lock 33*a* includes at least two channels for receiving and retaining cord 32*a*, and cord lock 33*a* is slidably adjustable along the length of cord 32*a*. As such, the length of cord 32*a* disposed between canopy support member 34*a* and second attachment point 14*a* can be adjusted by adjusting the location of cord lock 33*a*. Similarly, cord lock 33*b* includes at least two channels, receives and retains cord 32*b*, and can slidably adjust the length of cord 32*b* disposed tween canopy support member 34*b* and second attachment point 14*b*. Accordingly, the height of canopy support 22, and consequently the height of canopy cover 30, can be adjusted via the interaction between cord locks 33*a*, 33*b*, and cords 32*a*, 32*b*, respectively. The cord assembly allows an occupant to easily and quickly adjust the height of canopy cover 30 without the need to disconnect the entire assembly, and without requiring complex mechanical equipment.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above.

However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

What is claimed is:

1. An adjustable canopy assembly for a vehicle comprising:

a plurality of attachment points adapted to be disposed on the vehicle between a seat and a rear portion of the vehicle;

a frame support including a first set of angled support members and a second set of angled support members, each of the angled support members having a body extending from a first end to a second end, the first end adapted to secure against the vehicle via one of the plurality of attachment points, the second end adapted to couple to a connector disposed above the vehicle;

a canopy support coupled to the frame support via the connectors and adapted to extend away from the connector along a longitudinal length of the vehicle, the canopy support including a first longitudinal support member and a second longitudinal support member, each longitudinal support member disposed along the longitudinal length of the vehicle, and a plurality of transverse support members connected to each of the plurality of longitudinal support members; and a first cord securing the first longitudinal support member against one of the plurality of attachment points, and a second cord securing the second longitudinal support member against another of the plurality of attachment points, each of the first and second cords including a cord lock, the cord lock adapted to change a length of each of the first and second cords, thereby changing a distance between the canopy support and vehicle.

2. The adjustable canopy assembly of claim 1, further comprising a canopy cover attachable to the canopy support.

3. The adjustable canopy assembly of claim 1, wherein the plurality of attachment points further comprising:

a pair of first attachment points adapted to be disposed on the vehicle between a seat and a rear portion of the vehicle; and a pair of second attachment points adapted to be disposed on the vehicle between the seat and the pair of first attachment points.

4. The adjustable canopy assembly of claim 3, wherein:

each of the pair of first attachment points is adapted to be disposed on an opposing side of the vehicle and separated by a first distance; and each of the pair of second attachment points is adapted to be disposed on an opposing side of the vehicle and separated by a second distance, the second distance being greater than or equal to the first distance.

5. The adjustable canopy assembly of claim 1, further comprising:

a cross-connector having at least two channels disposed therein, the cross connector slidably securable about each of the first set of angled support members to secure one of the first set of angled support members to the other of the first set of angled support members, such that a translation of the cross-connector with relation to the first set of angled support members is adapted to change the distance between the canopy support and the vehicle.

6. The adjustable canopy assembly of claim 1, further comprising:

a cross-connector having at least two channels disposed therein, the cross connector slidably securable about each of the second set of angled support members to secure one of the second set of angled support members to the other of the first set of angled support members, such that a translation of the cross-connector with relation to the second set of angled support members is adapted to change the distance between the canopy support and the vehicle.

7. The adjustable canopy assembly of claim 1, wherein the connectors are tee-connectors having at least a first channel, a second channel, and a third channel disposed therein.

8. The adjustable canopy assembly of claim 7, wherein the first and second channels define an angle of between $80^{\circ}$ and $100^{\circ}$ therebetween.

9. The adjustable canopy assembly of claim 7, wherein the first and third channels define an angle of approximately 180" therebetween.

10. The adjustable canopy assembly of claim 7, wherein each of the first set of angled support members is secured within the first channel, each of the second set of angled support members is secured within the second channel, and the canopy support is secured within the third channel.

11. The adjustable canopy assembly of claim 1, wherein the canopy support further comprises:

a first canopy support tee-connector opposite a second canopy support tee-connector, each of the canopy support tee-connectors having at least a first channel, a second channel, and a third channel disposed therein, wherein the first and second longitudinal support members are secured within the first channels of each of the first and second canopy support tee-connectors;

a first canopy support member and a second canopy support member securable within the second channels of each of the first and second canopy support tee-connectors, the first channel and the second channel defining an angle of between $80^{\circ}$ and $100^{\circ}$ therebetween, the first and second canopy support members adapted to extend along the longitudinal length of the vehicle, wherein one of the plurality of transverse support members is securable within the third channel of each of the first and second canopy support tee-connectors, the second channel and the third channel defining an angle of approximately $180^{\circ}$ therebetween.

12. An adjustable canopy assembly comprising:

a pair of first attachment points adapted to be disposed on a vehicle between a seat and a rear portion of the vehicle, each of the pair of first attachment points being disposed on opposing sides of the vehicle and separated by a first distance;

a pair of second attachment points adapted to be disposed on the vehicle between the seat and the pair of first attachment points, each of the pair of second attachment points being disposed on opposing sides of the vehicle and separated by a second distance, the second distance being greater than or equal to the first distance;

a frame support including a first set of angled support members and a second set of angled support members, each of the angled support members having a body extending from a. first end to a second end;

the first ends of the first set of angled support members securable within one of the pair of first attachment points, and the first ends of the second set of angled support members securable within one of the pair of second attachment points;

the second end of each of the first set of angled support members securable within a first channel of one of a pair of opposing rear connectors, and the second end of each of the second set of angled support members securable within a second channel of one of the pair of opposing rear connectors, the rear connectors adapted to be disposed above the vehicle;

a canopy support coupled to the frame support via the pair of opposing rear connectors and adapted to extend away from the rear connectors along a longitudinal length of the vehicle, the canopy support including a first longitudinal support member and a second longitudinal support member, each longitudinal support member adapted to be disposed along the longitudinal length of the vehicle, and a plurality of transverse support members connected to each of the plurality of longitudinal support members; and a first cord securing the first longitudinal support member to one of the pair of second attachment points, and a second cord securing the second longitudinal support member to one of the pair of second attachment points, each of the first and second cords including a cord lock, the cord lock adapted to change a length of each of the first and second cords, thereby changing a distance between the canopy support and vehicle.

13. The adjustable canopy assembly of claim 12, further comprising a canopy cover attachable to the canopy support.

14. The adjustable canopy assembly of claim 12, further comprising:

a cross-connector having at least two channels disposed therein, the cross connector slidably securable about each of the first set of angled support members to secure one of the first set of angled support members to the other of the first set of angled support members, such that a translation of the cross-connector with relation to the first set of angled support members is adapted to change the distance between the canopy support and the vehicle.

15. The adjustable canopy assembly of claim 12, wherein the canopy support further comprises:

a first canopy support member securable to the first longitudinal support member and a second canopy support member securable to the second longitudinal support member, each of the first and second canopy support members adapted to extend along a longitudinal length of the vehicle toward a front portion of the vehicle.

16. The adjustable canopy assembly of claim 15, wherein one of the plurality of transverse support members secures the first canopy support member to the second canopy support member.

17. The adjustable canopy assembly of claim 16, wherein the one of the plurality of transverse support members securing the first canopy support member to the second canopy support member is longer than the other transverse support members, such that a canopy cover attached to the canopy support is adapted to provide a greater level of shade at a middle portion of the vehicle than at a front portion of the vehicle.

18. The adjustable canopy assembly of claim 15, further comprising:

a first canopy support tee-connector opposite a second canopy support tee-connector, each of the canopy support tee-connectors having at least a first channel, a second channel, and a third channel disposed therein, wherein the first and second longitudinal support members are secured within the first channels of each of the first and second canopy support tee-connectors, wherein the first canopy support member and the second canopy support member are securable within the second channels of each of the first and second canopy support tee-connectors, the first channel and the second channel defining an angle of between 80° and. 100° therebetween.

19. The adjustable canopy assembly of claim 12, wherein each of the opposing rear connectors is a tee-connector including the first channel, the second channel, and a third channel, wherein the first and second channels of each rear connector define an angle of between 80° and $100^0$ therebetween.

20. A method of adjusting a height of a canopy assembly secured to a vehicle, the method comprising the steps of:

providing an assembly including a frame support secured to a canopy support, the frame support including a first set of angled support members and a second set of angled support members, each of the angled support members having a body extending from a first end to a second end;

securing the first end of the first set of angled support members to a first attachment point disposed on a vehicle, and securing the first end of the second set of angled support members to a second attachment point disposed on the vehicle, the first attachment point and the second attachment point disposed on opposite sides of the vehicle;

securing the second end of each of the first and second sets of angled support members to the canopy support, such that the canopy support includes a first longitudinal support memeber and a second longitudinal support memeber that each extend away from the frame support along a longitudinal length of the vehicle;

attaching a first cord to the first longitudinal support member of the canopy support, and attaching a second cord to the second longitudinal support member of the canopy support;

attaching the first cord to the first attachment point, and attaching the second cord to the second attachment point, the first cord including an associated first cord lock and the second cord including an associated second cord lock, the first and second cord locks translatable along the first and second cords to select a length of the first and second cords; and adjusting the length of the first and second cords by translating the first cord lock along the first cord and translating the second cord lock along the second cord, thereby adjusting the height of the canopy support above the vehicle.

* * * * *